US005179390A

United States Patent [19]

Yokoyama et al.

[11] Patent Number: 5,179,390

[45] Date of Patent: Jan. 12, 1993

[54] THERMAL TRANSFER RECORDING APPARATUS THAT SECURELY TRANSPORTS THE INK CONTAINING MEMBER

[75] Inventors: Minoru Yokoyama, Yokohama; Yasushi Ishida, Tokyo; Akihiro Tomoda, Yokohama; Masakatsu Yamada, Yokohama; Takashi Awai, Yokohama; Takehiro Yoshida, Tokyo; Makoto Kobayashi, Tama; Satoshi Wada, Kawasaki; Takeshi Ono; Tomoyuki Takeda, both of Yokohama, all of Japan

[73] Assignee: Canon Kabushiki Kaisha, Tokyo, Japan

[21] Appl. No.: 550,730

[22] Filed: Jul. 10, 1990

[30] Foreign Application Priority Data

Jul. 10, 1989 [JP] Japan ..... 1-175551
Jun. 21, 1990 [JP] Japan ..... 2-161387

[51] Int. Cl.[5] ..... B41J 2/235; B41J 15/06

[52] U.S. Cl. ..... 346/76 PH; 346/136; 400/618; 400/619; 400/120

[58] Field of Search ..... 346/76 PH, 156; 400/120, 662, 618, 619

[56] References Cited

U.S. PATENT DOCUMENTS 4,456,392 6/1984 Nozaki et al. ..... 400/120
4,496,891 1/1985 Kobayashi ..... 318/696
4,683,480 7/1987 Sakamoto et al. ..... 346/136
4,973,985 11/1990 Genno et al. ..... 346/76 PH
5,001,410 3/1991 Ono ..... 318/696
5,001,498 3/1991 Shimizu et al. ..... 346/76 PH
5,008,607 4/1991 Ono et al. ..... 319/696

FOREIGN PATENT DOCUMENTS 57-83471 5/1982 Japan .
62-58917 1/1983 Japan .
0201686 11/1983 Japan .
0141575 7/1985 Japan .
0011569 6/1986 Japan .

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

A thermal transfer recording apparatus for image recording on a recording medium by transfer of ink from an ink sheet is taught. This apparatus includes recording means for transferring ink from the ink sheet onto a recording medium to record, a rotary member capable of rotation for transporting the recording medium, and transporting means for transporting the ink sheet with a relative speed with respect to the recording medium, wherein the frictional force between the recording medium and the rotary member is made larger than the shearing force in the ink in the ink sheet during the recording operation.

16 Claims, 14 Drawing Sheets

THERMAL TRANSFER RECORDING APPARATUS THAT SECURELY TRANSPORTS THE INK CONTAINING MEMBER

BACKGROUND OF THE INVENTION

Field of the Invention

The present invention relates to a thermal transfer recording apparatus for recording an image on a recording medium by transferring ink supported by an ink sheet onto said recording medium.

Such a thermal transfer recording apparatus may be used for example as a facsimile apparatus, an electronic typewriter, a copying apparatus or a printer.

Related Background Art

In general the thermal transfer printer utilizes an ink sheet composed of heat-fusible (or heat-sublimable) ink coated on a substrate film, and records an image by selectively heating the ink sheet with a thermal head corresponding to the image signal and transferring the thus fused (or subliming) ink onto a recording sheet. Since the ink sheet is generally a so-called one-time sheet of which ink is completely transferred to the recording sheet in one image recording, it is necessary, after recording of a character or a line, to advance the ink sheet corresponding to the length of recording thereby securely bringing an unused portion of the ink sheet to the next recording position. This operation increases the amount of consumption of the ink sheet, so that the running cost of such a thermal transfer printer tends to be higher than that of an ordinary thermal printer utilizing thermosensitive paper.

For resolving such drawback, there is already proposed a thermal transfer printer in which the recording sheet and the ink sheet are advanced with a mutual speed difference, as disclosed in the Japanese Laid-open Patent Applications Nos. 57-83471 and 58-201686, and in the Japanese Patent Publication No. 62-58917. Also for reducing the running cost of the thermal transfer printer, there is already known, as disclosed in the above-mentioned patents, the so-called multi-print ink sheet capable of plural image recordings at a same position. Such ink sheet allows, users in a continuous recording of a length L, to maintain the length of said ink sheet transported during or after said image recording smaller than said length L (L/n: n >1). Thus the efficiency of use of the ink sheet can be improved to n times in comparison with the conventional ink sheet, whereby a decrease in the running cost of the thermal transfer printer can be expected. Such a recording method is hereinafter called multi-printing method.

In multi-printing methods utilizing the above-explained ink sheet, the recording sheet and the ink sheet are transported in a same direction, as described in the above-mentioned patents. This relation can be represented by:

$$V_p = n \cdot V_1 (n > 1)$$

wherein $V_p$ is the speed of the recording sheet relative to the thermal head, while $V_1$ is the speed of the ink sheet relative to the thermal head. However the present inventors have experimentally found that a larger relative speed between the recording sheet and the ink sheet is advantageous in the multi-printing with the thermal transfer recording method.

Nevertheless, such multi-printing, requiring a large force for peeling the recording sheet and the ink sheet after recording, often results in sheet jamming or defective recording as the recording sheet is pulled by the ink sheet. These phenomena will be explained further in the following.

In conventional thermal transfer recording utilizing a one-time sheet, the ink is completely transferred and peeled from the substrate film by a heating. The recording sheet and the ink sheet, mutually adhered in the course of thermal transfer recording, are forcedly separated after the image recording, by forming an angle between the running paths of the two. Consequently the peeling force does not become a burden to the transportation of the recording sheet. However, in case of the above-mentioned multi-printing, the following loads will result in the transportation of the recording sheet:

1) shearing force between the ink layers on the ink sheet;
2) force required to separate the adhesion between the ink sheet and the thermal head resulting from heating; and
3) weight of the recording sheet.

Among these, the 2nd and 3rd are also present in the conventional one-time recording, but the shearing force in the 1st is far larger. In an experiment, said shearing force was in excess of 5 kg, when an entire line was recorded black. This value varies according to the characteristics of the ink sheet, but is evidently larger than other forces in any case. As the recording sheet is generally transported by the frictional force of a platen roller, it is pulled by the ink sheet and slips on the platen roller, thus resulting in defective transportation when the shearing force between the ink sheet and the recording sheet becomes large.

SUMMARY OF THE INVENTION

An object of the present invention is to provide a thermal transfer recording apparatus capable of providing a clear recorded image.

Another object of the present invention is to provide a thermal transfer recording apparatus capable of satisfactorily transporting the recording medium.

Still another object of the present invention is to provide a thermal transfer recording apparatus with improved precision of transportation of the recording medium, by increasing the contact area between the recording medium and the platen roller, thereby increasing the frictional force thereof to the recording medium.

DETAILED DESCRIPTION OF THE PREFERRED EMBODIMENTS

In an embodiment explained in the following, the frictional force between the recording medium and the platen roller which pinches the ink sheet and the recording medium in cooperation with the recording head and which advances the recording medium in contact therewith is made larger than the shearing force between the ink sheet and the ink layer. In combination with the rotation of the platen roller, the ink sheet is transported so as to have a relative speed difference between the ink sheet and the recording medium, and the ink sheet loaded in the ink sheet loading unit is subjected to the action of the recording head to record an image on the recording medium.

In the following the present invention will be clarified in detail by preferred embodiments thereof shown in the attached drawings.

EXPLANATION OF FACSIMILE APPARATUS (FIGS. 1-7)

Figure 1A:
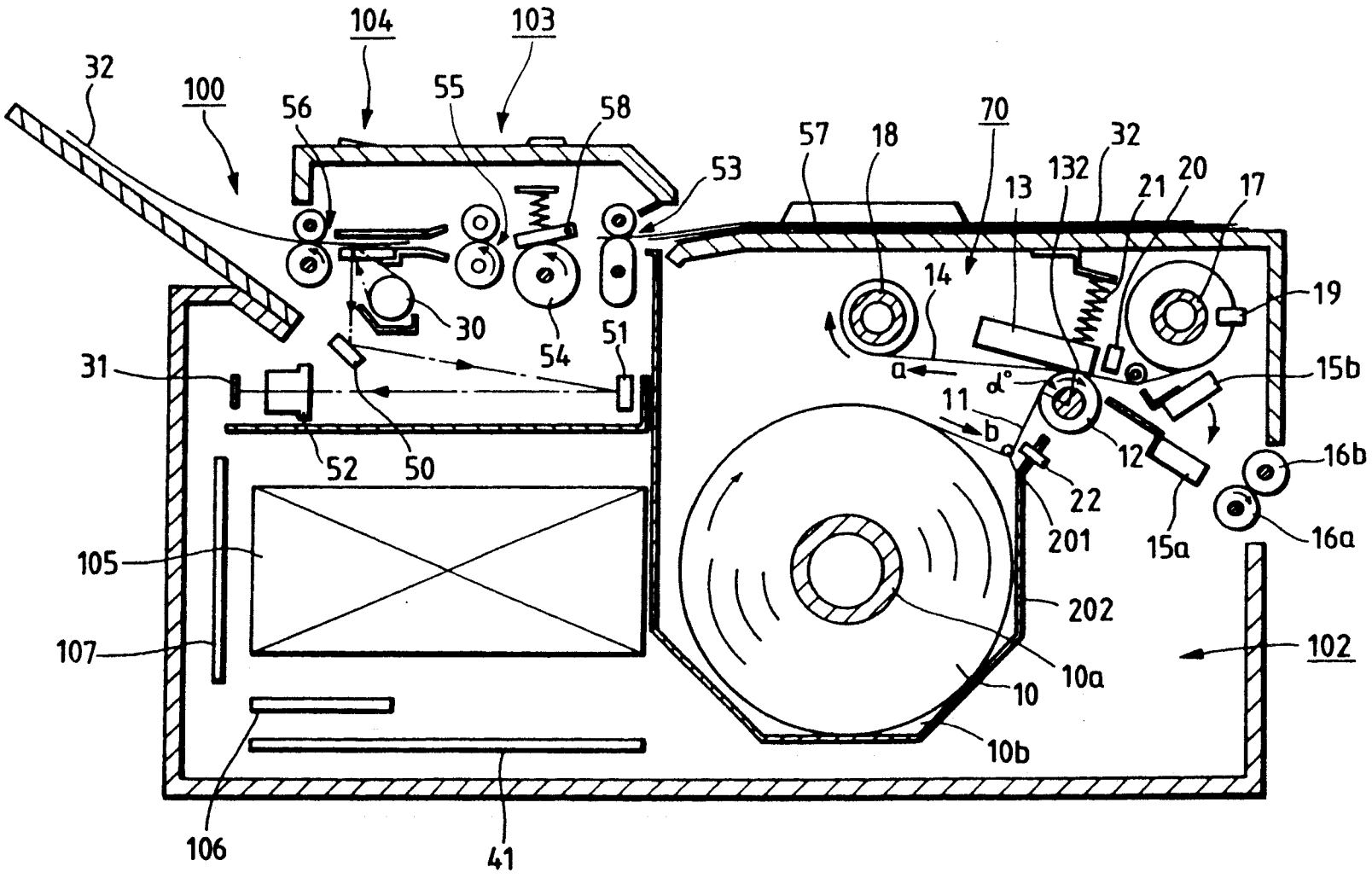
FIG. 1A is a lateral cross-sectional view of a facsimile apparatus embodying the present invention.
Figure 1B:
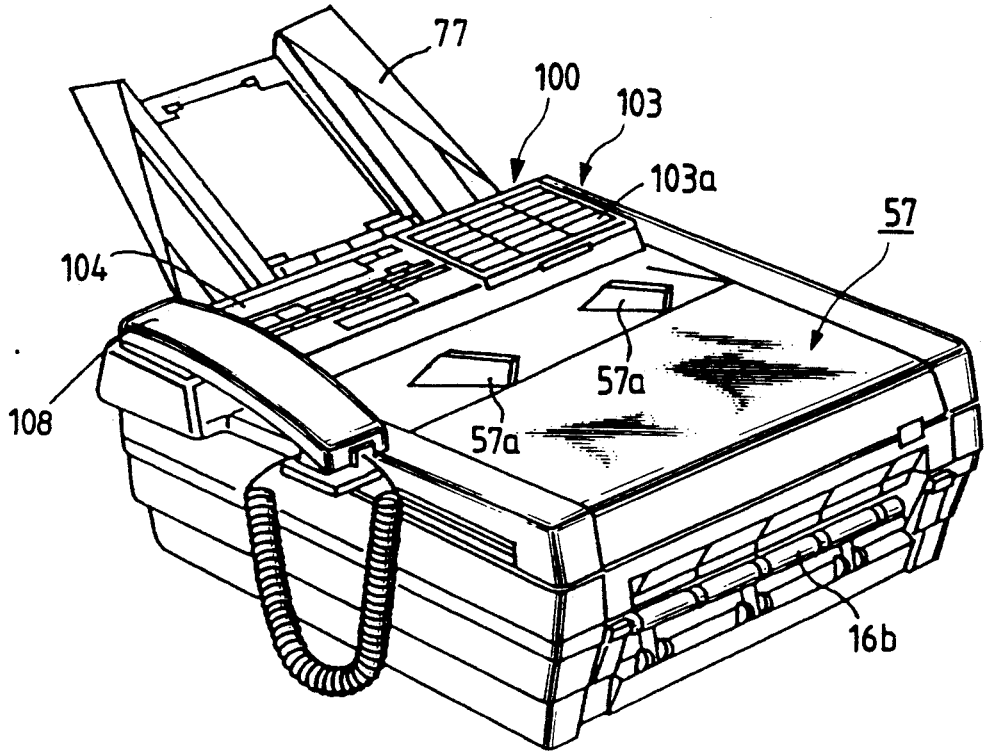
FIG. 1B is an external perspective view of the facsimile apparatus.
Figure 2:
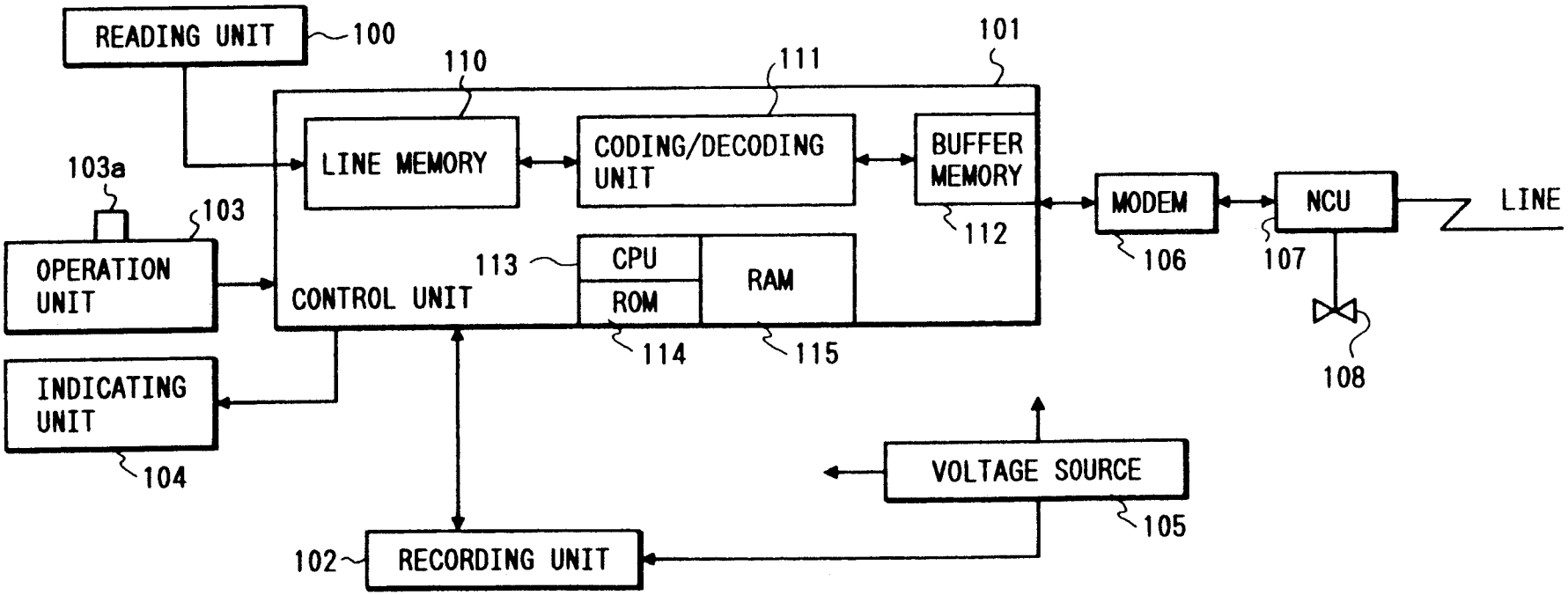
FIG. 2 is a block diagram showing the schematic structure of the facsimile apparatus.

FIGS. 1 to 7 illustrate an embodiment of the thermal transfer printer of the present invention applied to a facsimile apparatus, wherein FIG. 1A is a lateral cross-sectional view thereof, FIG. 1B is an external perspective view thereof, and FIG. 2 is a schematic block diagram thereof.

At first the schematic structure will be explained with reference to FIG. 2.

Referring to FIG. 2, a reading unit 100 photoelectrically reads the original image and sends the obtained digital image signal to a control unit 101 of the same apparatus (in the case of copy mode) or another apparatus (in the case of facsimile mode), and is equipped with an original transporting motor, a CCD image sensor etc. The control unit 101 is constructed in the following manner. A line memory 110, for storing image data of a line, stores the image data of a line from the reading unit 100 in case of original image transmission (in facsimile mode) or copying (in copy mode), or the received and decoded image data of a line in the case of image data reception. The image formation is conducted by the transfer of the stored data to a recording unit 102. An encoding/decoding unit 111 encodes the image information to be transmitted, for example by MH encoding, and decodes the received image codes into image data. A buffer memory 112 is used for storing the encoded image data which are to be transmitted or are received. These components of the control unit 101 are controlled by a CPU 113 composed for example of a microprocessor. In addition to CPU 113, the control unit 101 is provided with a ROM 114 storing control program of the CPU 113 and various data, and a RAM 115 for temporarily storing various data as a work area for the CPU 113.

A recording unit 102 is provided with a thermal line head, having plural heat-generating elements 132 over the width of recording, and effects image recording on a recording sheet by the thermal transfer recording method. The structure of the unit will be explained in more detail later. An operation unit 103 is provided with various function keys such as a transmission start key, and input keys for telephone numbers. A switch 103*a*, used for indicating the kind of the ink sheet 14 to be employed, indicates a multi-print ink sheet or an ordinary one time ink sheet respectively when it is on or off. A display unit 104 indicates the state of various functions set by the operation unit 103 and the state of the apparatus. A power source unit 105 supplies the entire apparatus with electric power. There are further provided a modem (modulator-demodulator) for AC-DC conversion of the transmission or reception signal, a network control unit (NCU) 107 for communication control for an outside line, and a telephone set 108 with a telephone dial.

In the following there will be explained the structure of the recording unit 102 with reference to FIG. 1, wherein same components as those in FIG. 1 are represented by same numbers.

A rolled sheet 10, composed of plain recording paper 11 wound on a core 10*a*, is rotatably housed in the apparatus so as to feed the recording sheet 11 to a thermal head unit 13 by the rotation of a platen roller 12 in the direction of the arrow. The recording sheet 11 pulled out of the roll 10 is at first guided downwards by a guide shaft 201, then guided to the platen roller 12 positioned above and wound thereon. A rolled sheet loading unit 10*b* detachably houses the rolled sheet 10. The platen roller 12 advances the recording sheet 11 in a direction b, and presses an ink sheet 14 and the recording sheet 11 to the heat-generating elements 132 of the thermal head 13. Stated in another way, the thermal head 13 is pressed to the platen roller 12 across the ink sheet 14 and the recording sheet 11. After the image recording by the transfer of ink from the ink sheet 14 by the heat generated by the thermal head 13, the recording sheet 11 is advanced toward discharge rollers 16*a*, 16*b* by further rotation of the platen roller 12. Upon completion of image recording of a page, the recording sheet is cut into a page by the engagement of cutter members 15*a*, 15*b* and is discharged.

An ink sheet feed roll 17 having wound ink sheet 14 and an ink sheet takeup roll 18 are driven by an ink sheet motor 25 to be explained later, for advancing the ink sheet 14 in a direction a. The ink sheet feed roll 17 and ink sheet takeup roll 18 are detachably loaded in an ink sheet loading unit 70 of the apparatus. There are further provided a sensor 19 for detecting the remaining amount and the transport speed of the ink sheet 14; an ink sheet sensor 20 for detecting the presence or absence of the ink sheet 14; a spring 21 for pressing the thermal head 13 to the platen roller 12 across the recording sheet 11 and the ink sheet 14; and a recording sheet sensor 22 for detecting the presence or absence of the recording sheet.

In the following there will be explained the structure of the reading unit 100.

Referring to FIG. 1A, a light source 30 illuminates an original image 32. The light reflected by the original image 32 is guided through an optical system (mirrors 50, 51 and a lens 52) to the CCD sensor 31 and converted into an electrical signal. The original 32 is transported at a speed corresponding to the reading speed for the original, by means of transport rollers 53, 54, 55, 56 driven by an original transporting motor (not shown). An original stacker 57 can support plural originals. The originals are guided by a slider 57*a*, then separated one by one, by the cooperation of a transport roller 54 and a separating member 58, are subjected to image reading in the reading unit 100 and are then discharged to a tray 77.

There are also provided a control circuit board 41 constituting the principal part of the control unit 101 and sending control signals to the various units of the apparatus; a modem circuit board 106; and an NCU circuit board 107.

Figure 3:
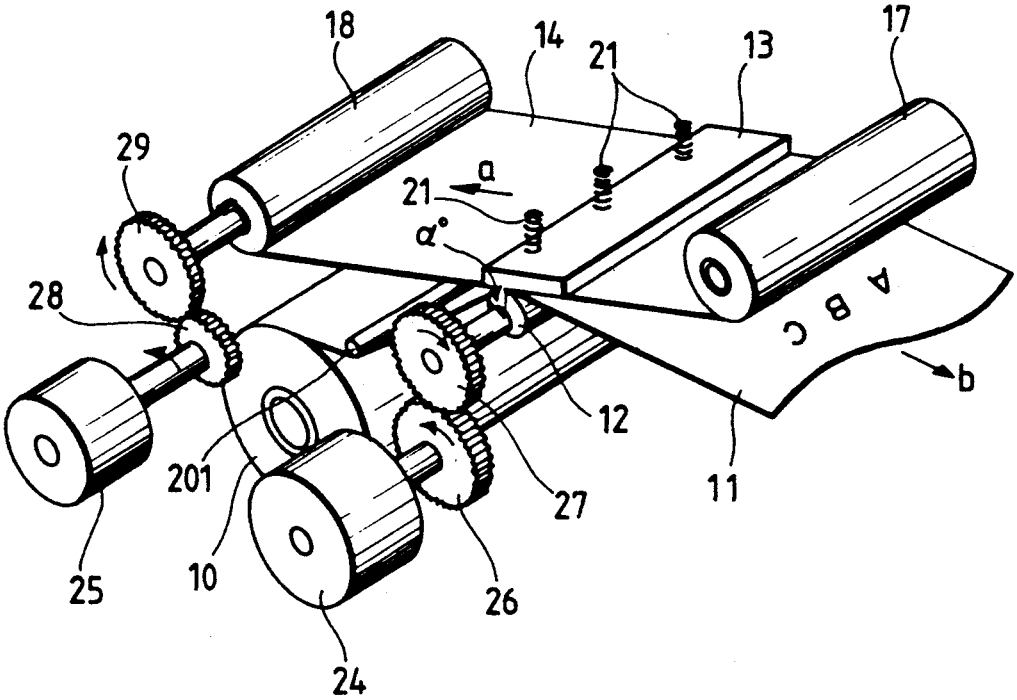
FIG. 3 is a perspective view of a transport system for the ink sheet and the recording sheet in the first embodiment.

FIG. 3 shows the details of a transport mechanism for the ink sheet 14 and the recording sheet 11.

A recording sheet transport motor 24 rotates the platen roller 12, thereby advancing the recording sheet in a direction b which is opposite to the direction a. An ink sheet transport motor 25 advances the ink sheet 14 in the direction a. There are also provided gears 26, 27 for transmitting the rotation of the recording sheet transport motor 24 to the platen roller 12, and gears 28, 29 for transmitting the rotation of the ink sheet transport motor 25 to the takeup roll 18.

As the recording sheet 11 and the ink sheet 14 are transported in mutually opposite directions, the direction of successive image recording along the recording sheet 11 (direction a which is opposite to the transport direction of the recording sheet 11) coincides with the transport direction of the ink sheet 14. By writing the transport speed $V_P$ of the recording sheet 11 as $V_P = -n \cdot V_I$ (wherein $V_I$ is the transport speed of the ink sheet 14, and the sign "−" signifies that the transport direction of the recording sheet 11 is opposite to that of the ink sheet 14), the relative speed $V_{PI}$ between the recording sheet 11 and the ink sheet 14 can be represented as:

$$V_{PI} = V_P - V_I = (1 + 1/n)V_P.$$

Thus the relative speed $V_{PI}$ is larger than $V_P$ or the conventional relative speed $V_{PI}' = (1 - 1/n)V_P$.

In addition to the method explained above, there may be employed a method, in the case of recording n lines with the thermal head 13, of advancing the ink sheet in the direction a by an amount l/m for every n/m lines, wherein m is an integer satisfying a relation $n > m$, or a method, in case of recording over a length L, of advancing the ink sheet at the same speed as that of the recording sheet 11 but in the opposite direction during the recording operation and rewinding the ink sheet 14 by an amount $L \cdot (n - 1)/n$ before the next recording of a predetermined amount, (wherein $n > 1$). In either case, the relative speed is $V_P$ if the ink sheet 14 is stopped at the recording, or $2V_P$ if the ink sheet 14 is moved at the recording.

Figure 4:
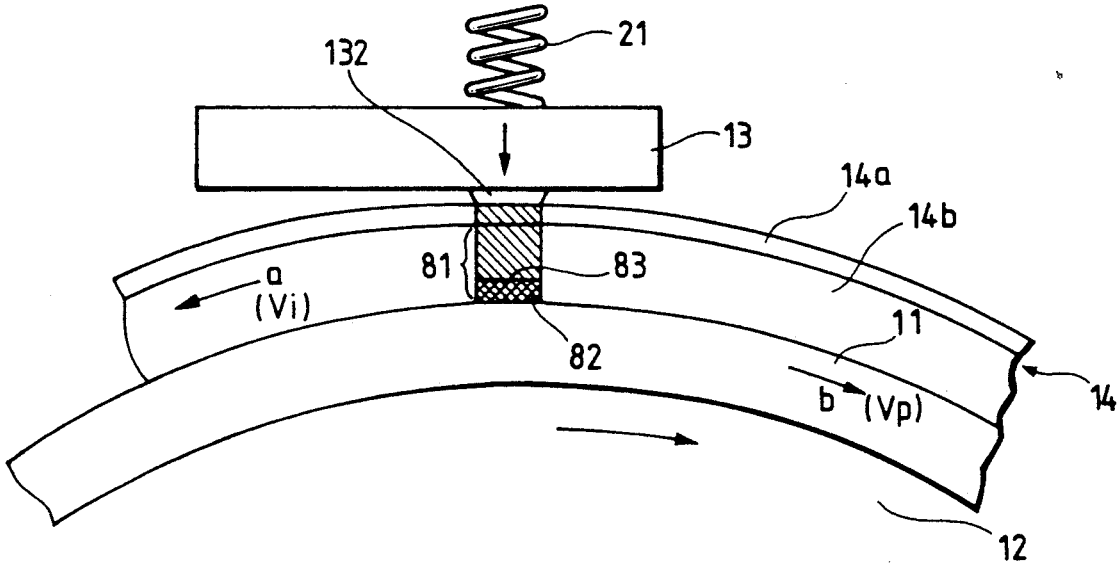
FIG. 4 is a cross-sectional view showing the state of recording sheet and ink sheet at the recording in the embodiment.

FIG. 4 shows the state of image recording by multi-printing method in the present embodiment in which the recording sheet 11 and the ink sheet 14 are moved in mutually opposite directions.

As shown in FIG. 4, the recording sheet 11 and the ink sheet 14 are pinched between the platen roller 12 and the thermal head 13, which is pressed against the platen roller 12 at a predetermined pressure exerted by the spring 21. The recording sheet is transported in the direction b with the speed $V_P$, by the rotation of the platen roller 12. On the other hand, the ink sheet 14 is advanced in the direction a with the speed $V_I$, by the rotation of the ink sheet transport motor 25. However, as will be explained later, the ink sheet 14 may be maintained in a stopped state.

When the heat-generating elements 132 of the thermal head 13 are energized by the power source unit 105, a hatched area 81 of the ink sheet 14 is heated. 14*a* indicates the substrate film of the ink sheet, while 14*b* indicates the ink layer thereof. Energization of the heat-generating elements 132 fuses the ink of the ink layer 81, and a part 82 thereof is transferred to the recording sheet 11. The transferred part 82 is about 1/n of the ink layer 81.

At this transfer, it is necessary to generate a shearing force at a boundary line 83 of the ink layer 14*b*, thereby transferring the ink layer portion 82 only onto the recording sheet 11. However this shearing force varies depending on the temperature of the ink layer, and tends to become smaller as the temperature of the ink layer increases In the present embodiment, the shearing force tends to increase as the heating time of the thermal head 13 of the facsimile apparatus is as short as ca. 0.6 ms. For this reason, the contact area between the recording sheet 11 and the platen roller 12 is increased to elevate the frictional force therebetween, and the ink sheet 14 and the recording sheet 11 are transported in mutually opposite directions thereby increasing the relative speed therebetween and facilitating the peeling of the ink layer.

The foregoing embodiment will be clarified further in the following with reference to FIG. 5A, which is a magnified view of the transporting mechanism for the ink sheet 14 and the recording sheet 11.

Since the recording sheet 11 and the ink sheet 14 are transported in mutually opposite directions as explained in relation to FIG. 4, a very large shearing force is applied to the ink sheet 14 at the transfer recording. As the ink sheet 14 is advanced in a direction a by the takeup reel 18, the recording sheet 11 is subjected to a load corresponding to the shearing force and directed in a direction a. The recording sheet 11 is subjected to transporting force in the direction b solely by the frictional force thereof with the platen roller 12. Consequently, in order to provide the recording sheet 11 with a transporting force in the direction b sufficient to overcome the load, the contact angle $\alpha$ of the recording sheet 11 and the platen roller 12 is increased to enlarge the contact area therebetween, thereby increasing the frictional force therebetween. For this purpose, in the present embodiment, a guide shaft 201 is provided at the upstream side of the platen roller with respect to the transport direction of the recording sheet 11 and below the platen roller 12. Because of the presence of the guide shaft 201, the recording sheet 11 is once guided to a position lower than the platen roller 12 and comes into contact with the periphery thereof from below. After being superposed with the ink sheet 14 and passing through the recording (heating) position by the thermal head 13, the recording sheet 11 is separated from the ink sheet 14 and guided to the direction of discharge. Thus the recording sheet 11 receives an increased transporting force in the direction b due to the increase of the contact area thereof with the platen roller 12, whereby the recording sheet 11 can be properly advanced without being pulled in the opposite direction a by the shearing force exerted by the ink sheet 14. As explained in the foregoing, in the present embodiment, the contact angle (wrapping angle) $\alpha$ is maintained above a predetermined value by the presence of the guide shaft 201-at the sheet feeding side of the platen roller. The contact angle $\alpha$ (FIG. 5A or 5B) varies depending on the rubber hardness, friction coefficient, outer diameter etc. of the platen roller 12, but, in an experimental case of a platen roller of a diameter of 20 mm composed of silicone rubber or chloroprene rubber of a hardness (JIS rubber hardness) of 40°, the contact angle is selected within a range from ca. 45° to ca. 110°, preferably from ca. 60° to ca. 90° and most preferably from ca. 70° to ca. 85°. A guide shaft 203 is provided for guiding the ink sheet 14.

Figure 5A:
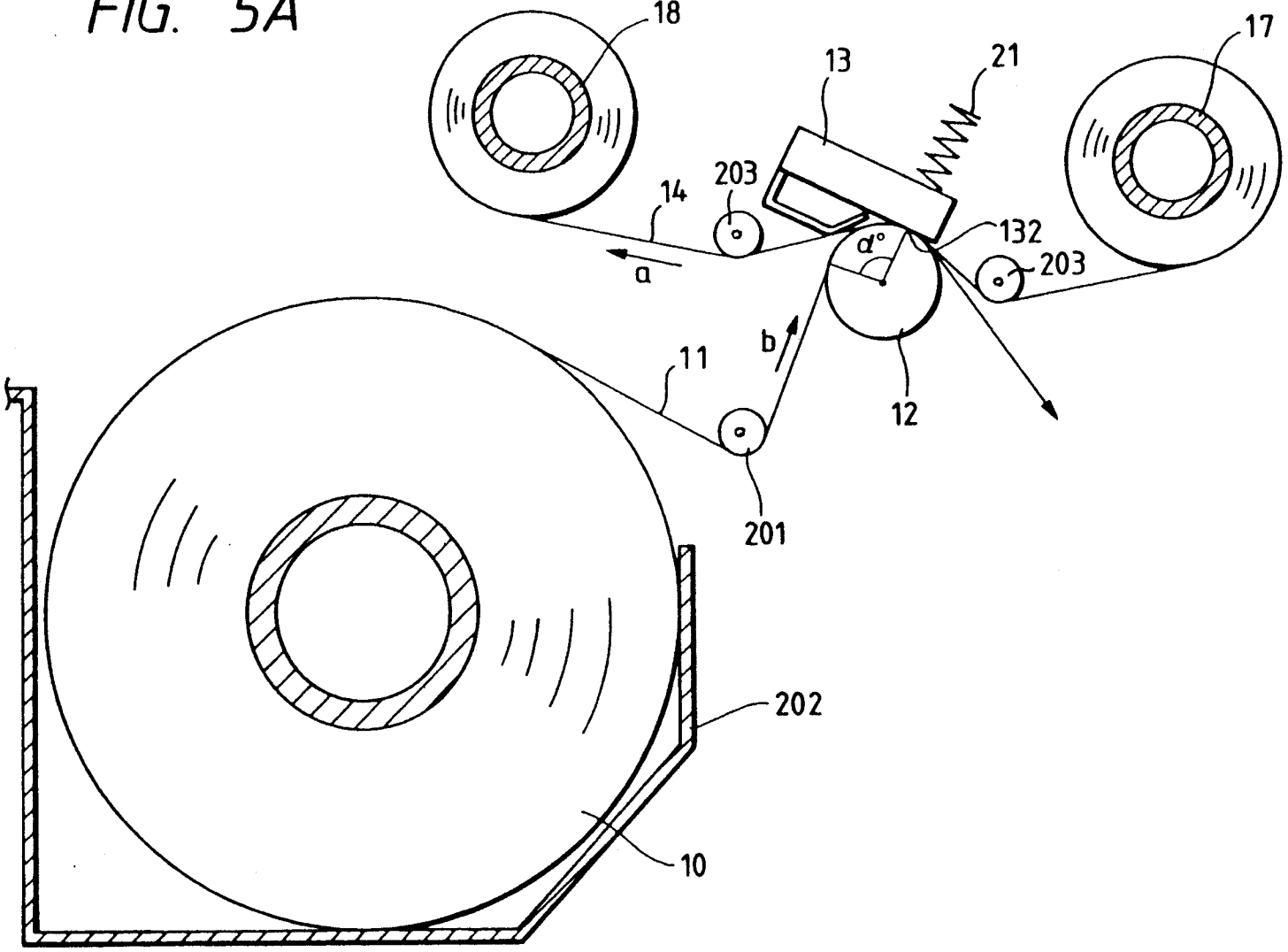
FIG. 5A is a magnified view of transport paths of the ink sheet and the recording sheet around the thermal head.
Figure 5B:
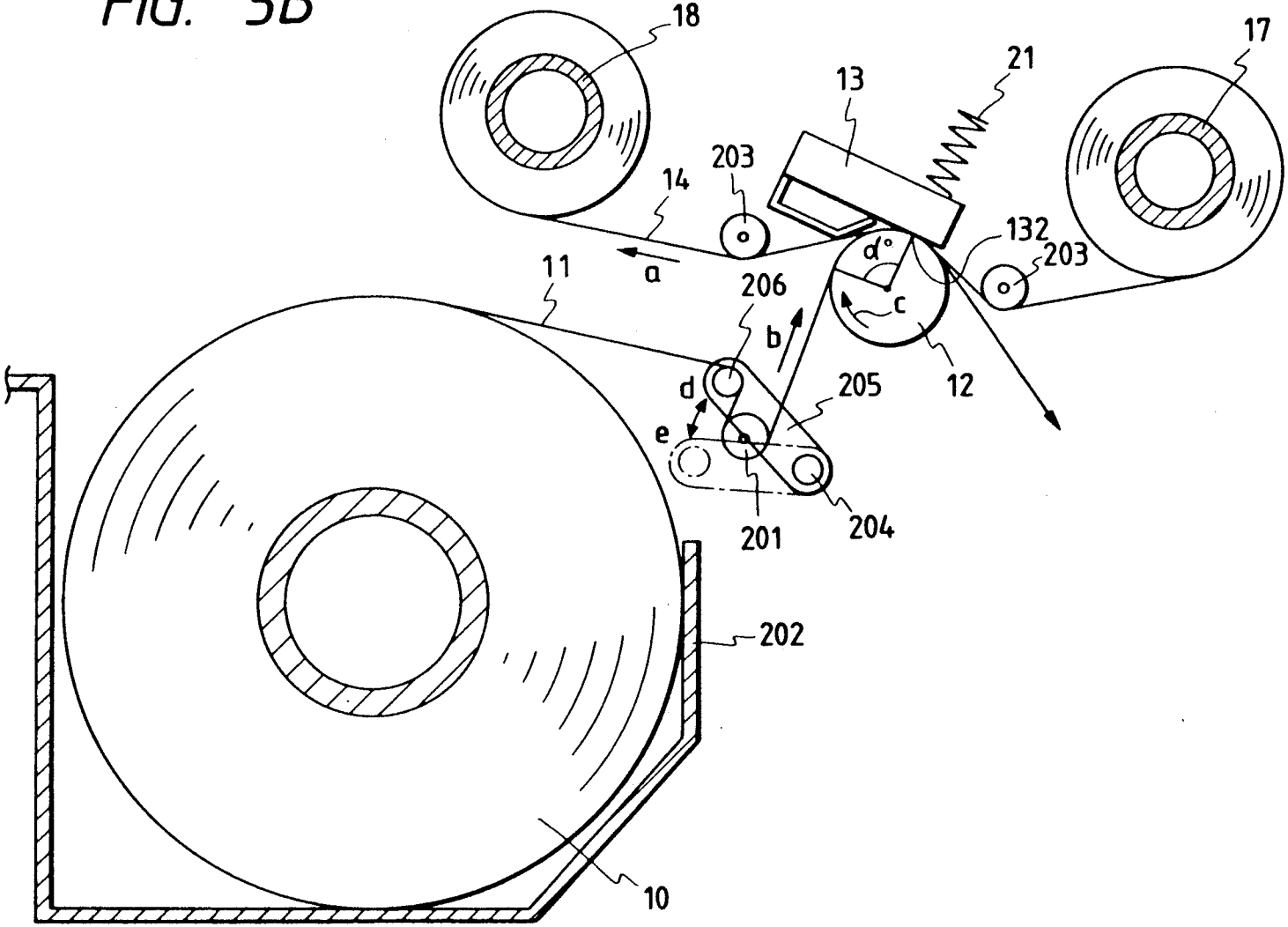
FIG. 5B is a magnified view of another embodiment.

Now reference is made to FIG. 5B for explaining another embodiment of the transport mechanism for the ink sheet 14 and the recording sheet 11, wherein the same components as those in FIG. 5A are represented by the same numbers.

This embodiment also includes has a decurling function for the recording sheet 11, and uses the guide shaft 201 to accomplish the decurling function. More specifically, an arm 205 is rotatably supported about a shaft 204, and a guide shaft 206 is mounted at an end of the shaft 205. The recording sheet 11 is transported in a direction b by the rotation of the platen roller 12 in a direction c by a motor (not shown). At the same time, the power of the motor is transmitted to a slip clutch (not shown), thereby rotating the arm 205 fixed to the shaft 204 in a direction d. Rotation of the arm 205 in the direction d moves the guide shaft 206 in the same direction, thereby bringing it into contact with the recording sheet 11. Consequently the transport path of the recording sheet 11 is defined by the roll 10, guide shaft 206, guide shaft 201 and platen roller 12. In this transport path the recording sheet 11 wraps the guide shaft 206 in the same direction as the winding direction of the roll 10, but wraps the guide shaft 201 in an opposite direction. The recording sheet 11 is decurled by this wrapping on the guide shaft 206. In this manner, the guide shaft 206 additionally performs the decurling function in the present embodiment. Also in the present embodiment, the arm 205 rotates according to the tension of the recording sheet 11, the tension being dependent on the weight of the roll 10 which becomes lighter as the diameter thereof is reduced. Consequently the wrapping amount of the recording sheet 11 on the guide shaft 11 increases as the roll 10 becomes smaller in diameter.

The foregoing embodiments employ a guide shaft, but the same benefits can be obtained by a suitable relative positioning of the recording sheet holder 202 so as to maintain the wrapping angle $\alpha$ at least at a predetermined value.

At the polishing of the platen roller 12, the surface thereof is preferably made rougher, in order to increase the frictional force.

In the present embodiment, as explained above, the recording sheet 11 is securely transported since the frictional force between the recording sheet 11 and the platen roller 12 is made larger than the shearing force of the ink of the ink sheet 14 at the recording. This shearing force refers to either that between the ink layers of the ink sheet 14 or that between the ink layer and the substrate film of the ink sheet 14.

Figure 6:
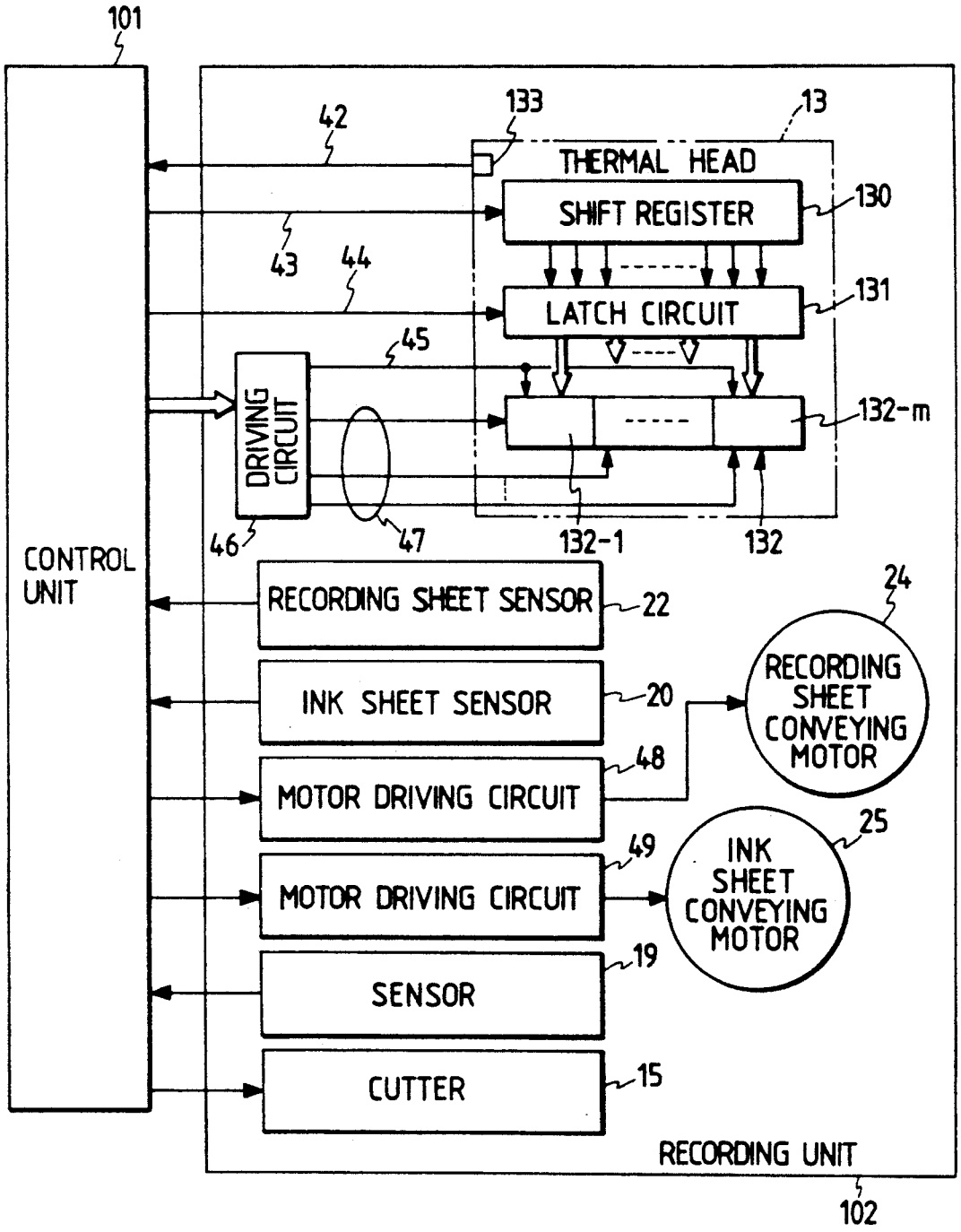
FIG. 6 is a block diagram showing electrical connections between a control unit and a recording unit in the first embodiment.

FIG. 6 shows the electrical connections between the control unit 101 and the recording unit 102 in the facsimile apparatus of the present embodiment, wherein the same components as those in other drawings are represented by the same numbers.

The thermal head 13 is composed of a line head, and is provided with a shift register 130 for storing serial recording data 43 of a line supplied from the control unit 101, a latch circuit 131 for latching the data of the shift register 130 by a latch signal 44, and heat-generating elements 132 composed of plural heat-generating resistors of a line. The heat-generating resistors 132 are driven in divided manner in a m blocks 132-*l*–132-*m*. A temperature sensor 133 is mounted on the thermal head 13 for detecting the temperature thereof. The output signal 42 of temperature sensor 133 is A/D converted in the control unit 101 and supplied to CPU 113, which in response detects the temperature of the thermal head 13 and accordingly regulates the energy supplied to the thermal head 13 depending on the characteristics of the ink sheet 14, for example by varying the pulse duration of a strobe signal 47 or by varying the drive voltage for the thermal head 13. The characteristics or kind of the ink sheet 14 is designated by the aforementioned switch 103*a*. However, the characteristics or kind of the ink sheet may be identified by a mark printed on the ink sheet 14, or by a mark, a notch or a projection provided on the cartridge of the ink sheet.

A driving circuit 46 receives a drive signal for the thermal head 13 from the control unit 101, and generates a strobe signal 47 for driving each block of the thermal head 13. The driving circuit 46 is capable, in response to a command of the control unit 101, of varying the energy supplied to the thermal head 13 by varying the voltage to a power supply line 45 for current supply to the heat-generating elements 132 of the thermal head 13. Motor driving circuits 48, 49 are provided for respectively driving the recording sheet motor 24 and the ink sheet motor 25. The motors are stepping motors in the present embodiment, but they may also be, for example, of DC motors.

RECORDING OPERATION (FIGS. 1–7)

Figure 7:
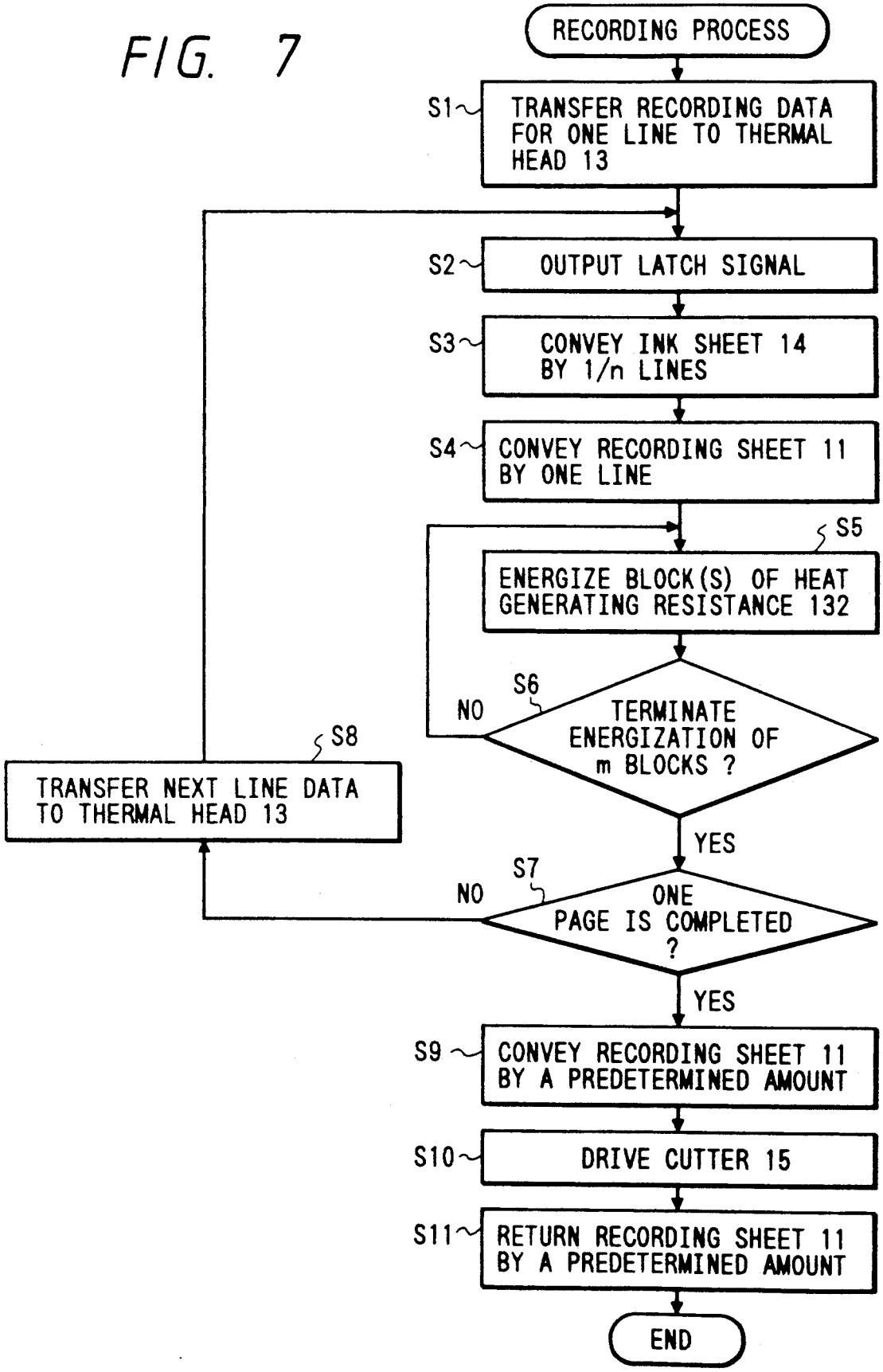
FIG. 7 is a flow chart of the recording sequence of the first embodiment.

FIG. 7 is a flow chart of a page recording sequence in the facsimile apparatus of the present embodiment, and a corresponding program is stored in the ROM 114 of the control unit 101.

The sequence is started when the image data of a line to be recorded are stored in the line memory 110 whereby the recording operation is enabled. At first step S1 transfers the recording data of a line serially to the shift register 130. Upon completion of the data transfer, step S2 generates the latch signal 44 to store the recording data of a line in the latch circuit 131. Then a step S3 activates the ink sheet motor 25 thereby transporting the ink sheet 14 in the direction a shown in FIG. 1, by an amount of 1/n lines. Step S4 then activates the recording sheet motor 24 to advance the recording sheet 11 by an amount corresponding to a line, in the direction b. This line corresponds to the length of a dot recorded by the thermal head 13.

The next step S5 energizes each block of the heat-generating elements 132 of the thermal head 13. Then step S6 discriminates whether all the blocks m have been energized, and, upon completion of the recording of a line by energization of m blocks, step S7 discriminates whether the recording of a page has been completed. If not, a step transfers the recording data of a next line to the thermal head 13, and the sequence returns, to step S2.

In a cutting operation in steps S7 to S12, while the recording sheet 11 is transported, the ink sheet 14 may be transported with a speed $V_P/n$ in a direction opposite to the advancing direction of the recording sheet 11 as in the course of image recording, or with a larger value of n than in the image recording. Furthermore, it may be moved by the platen roller 12 in the same manner as the recording sheet 11, or may be maintained in the stopped state.

When the step S7 identifies the completion of recording of a page, step S9 advances the recording sheet 11 by a predetermined amount toward the discharge rollers 16*a*, 16*b*. Then step S10 activates the cutter members 15*a*, 15*b* into mutual engagement, thereby cutting the recording sheet 11 into a page length. Then step S11 reverses the recording sheet 11 by a length equal to the distance between the thermal head 13 and the cutter 15, whereupon the recording sequence of a page is terminated.

The aforementioned value n, determining the amount of advancement of the ink sheet 14, can be varied not only by the amounts of rotation of the recording sheet motor 24 and the ink sheet motor 25, but also by the reduction ratios of the gears 26, 27 of the platen roller 12 and the gears 28, 29 of the takeup roller 18. In case the motors 24, 25 are both stepping motors, the value n may be determined by selecting mutually different minimum stepping angles for motors 24, 25. In this manner the relative speed of the recording sheet 11 and the ink sheet 14 can be selected as $(1+2/n)V_P$.

As indicated by the steps S3 and S4, the ink sheet motor 25 is preferably activated prior to the recording sheet motor 24, because the start of actual transportation of the ink sheet 14 is delayed from the activation of the ink sheet motor 25 because of the characteristics of said motor and the transmission system thereof. A similar effect can be expected even when the recording sheet motor 24 is activated first, but then there may result drawbacks such as an undesired gap formed between the recorded dots if the interval from the start of transportation of the recording sheet 11 to the energization of the thermal head 13 (recording operation in step S4) becomes too long.

Figure 8:
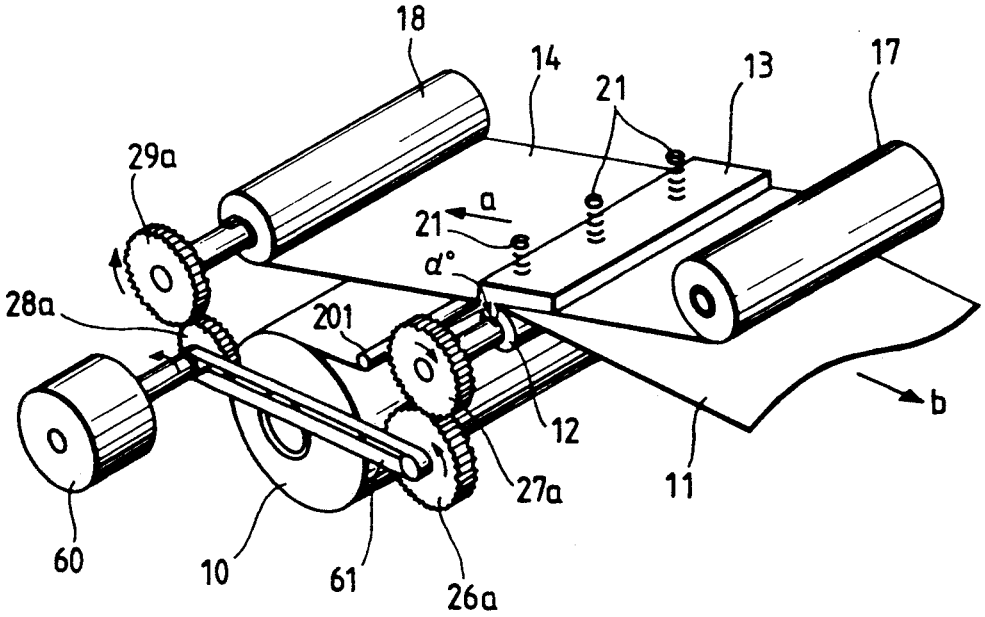
FIG. 8 is a perspective view of a transport system for the ink sheet and the recording sheet in a second embodiment.
Figure 9:
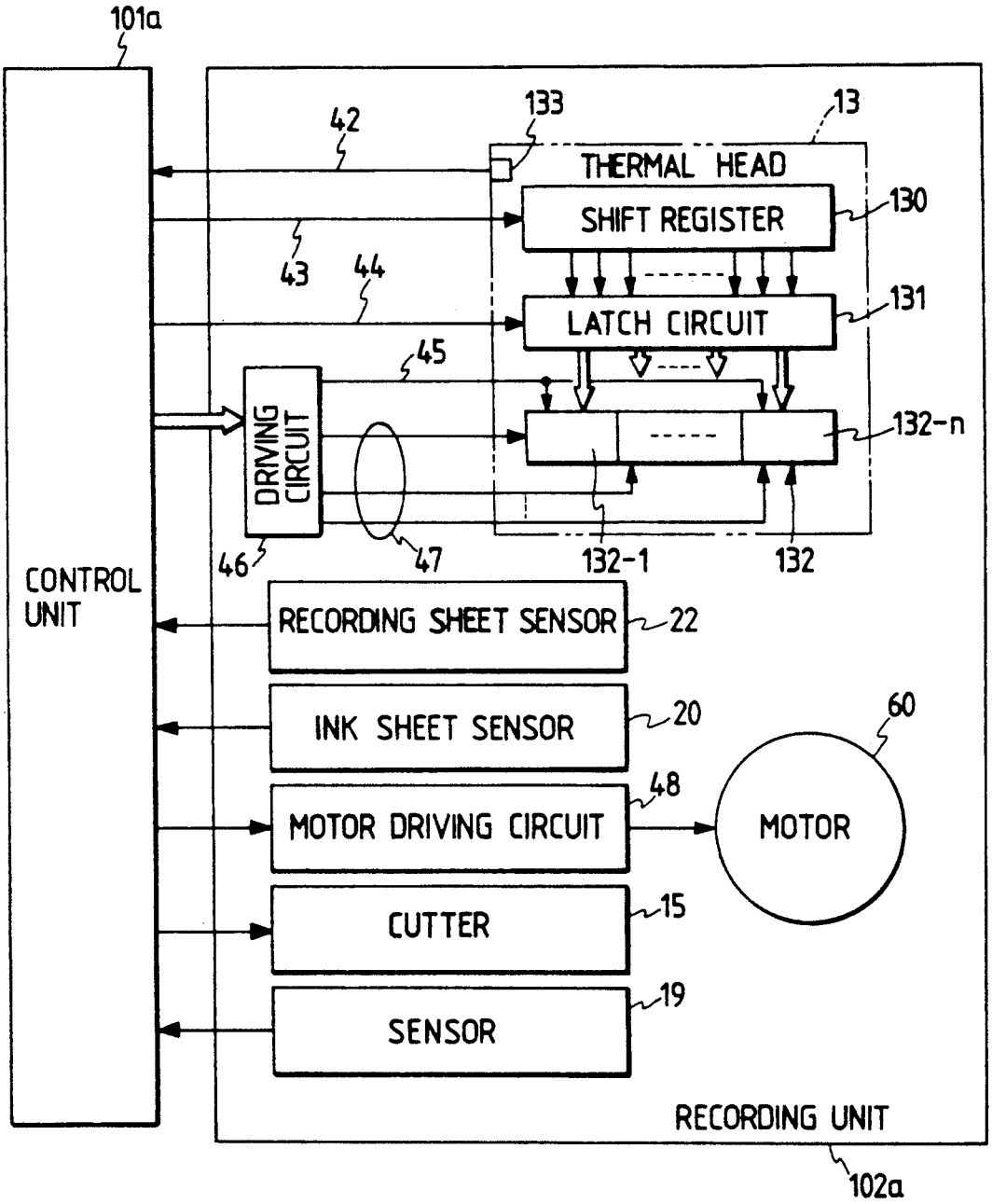
FIG. 9 is a block diagram showing electrical connections between a control unit and a recording unit in the second embodiment.

2nd EMBODIMENT (FIGS. 8 AND 9)

FIG. 8 illustrates a 2nd embodiment in which a single motor is used for transporting the recording sheet 11 and the ink sheet 14, wherein the same components as those in the 1st embodiment in FIG. 3 are represented by the same numbers. In this embodiment, a motor 60 drives the takeup roller 18 through transmission gears 28*a*, 29*a*, and also drives the platen roller 12 through a belt 61 and gears 26', 27'.

FIG. 9 shows the electrical connections between the control unit 101*a* and the recording unit 102*a* in the present embodiment. As will be apparent from comparison with FIG. 6, the recording sheet motor 24 and the ink sheet motor 25 are replaced by a single motor 60. In the present embodiment, the aforementioned value n can be varied by altering the reduction ratio of the gears 26*a*, 27*a* and that of the gears 28*a*, 29*a*. In this embodiment, the transporting speed (or takeup amount) of the ink sheet varies depending also on the diameter of the takeup roller 18 of the ink sheet 14. For this reason, the transporting speed of the ink sheet 14 varies, though slightly, between the initial portion and the final portion of the ink sheet 14.

Figure 10:
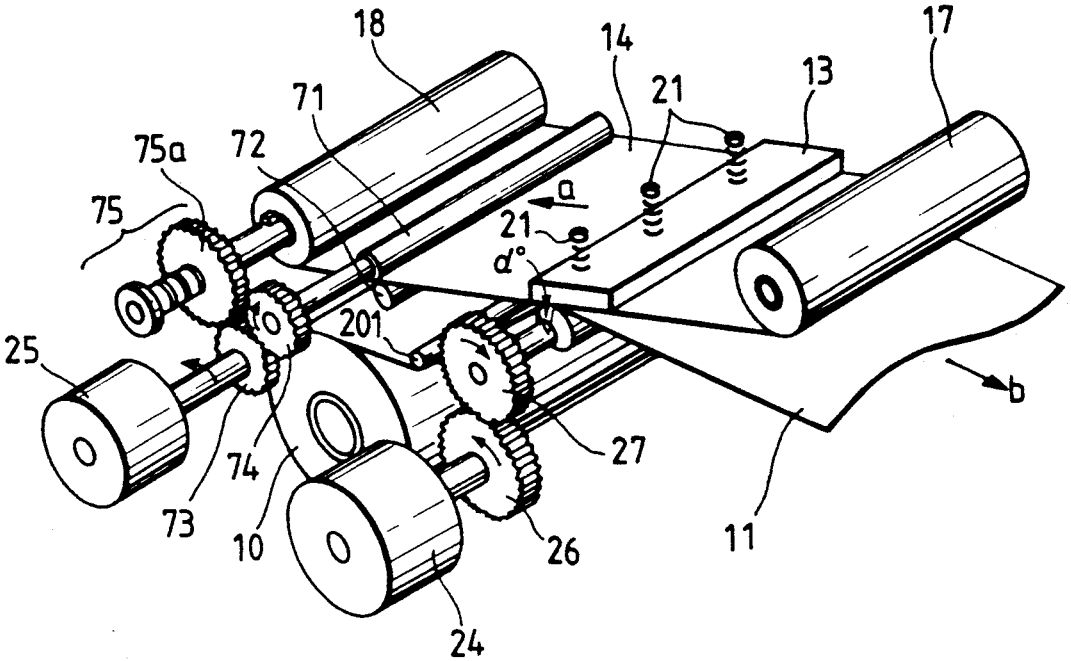
FIG. 10 is a perspective view of a transport system for the ink sheet and the recording sheet in a third embodiment.

3rd EMBODIMENT (FIG. 10)

FIG. 10 shows a mechanism capable of transporting a constant length regardless of the diameter of the ink sheet takeup roll 18, by advancing the ink sheet 14 in the direction a by means of a capstan roller 71 and a pinch roller 72 instead of using the direct driving of the takeup roller 18 as in the foregoing embodiments. The components as those in FIG. 3 are represented by the same numbers.

In FIG. 10, there are provided reduction gears 73, 74; and a slip clutch 75. The aforementioned value n can be determined by suitable selection of the reduction ratio $i_I$ of the gears 73, 74 for the ink sheet motor 25 and that $i_P$ of the gears 26, 27 for the recording sheet motor 24. The ink sheet 14, advanced by the capstan roller 71 and the pinch roller 72, can be taken up by the engagement of the gear 73 and a gear 75*a* of the slip clutch 75.

The ink sheet 14 advanced by the capstan roller 71 can be securely taken up by the roll 18 by selecting the ratio of the gears 74, 75*a* in such a manner that the length of the ink sheet 14 taken up by the roll 18 by the rotation of the gear 75*a* is longer than the length of the ink sheet advanced by the capstan roller 71. The difference between the amount of the ink sheet 14 taken up by the roll 18 and that advanced by the capstan roller 71 is absorbed by the slip clutch unit 75. It is thus rendered possible to prevent the variation in the transporting speed of the ink sheet 14 resulting from the variation in the winding diameter of the roll 18.

Furthermore, the ink sheet motor 25 in FIG. 10 may be replaced by a motor 60 as shown in FIG. 8, thereby dispensing with the motor 24 and advancing the ink sheet 14 and the recording sheet with one motor.

Figure 11:
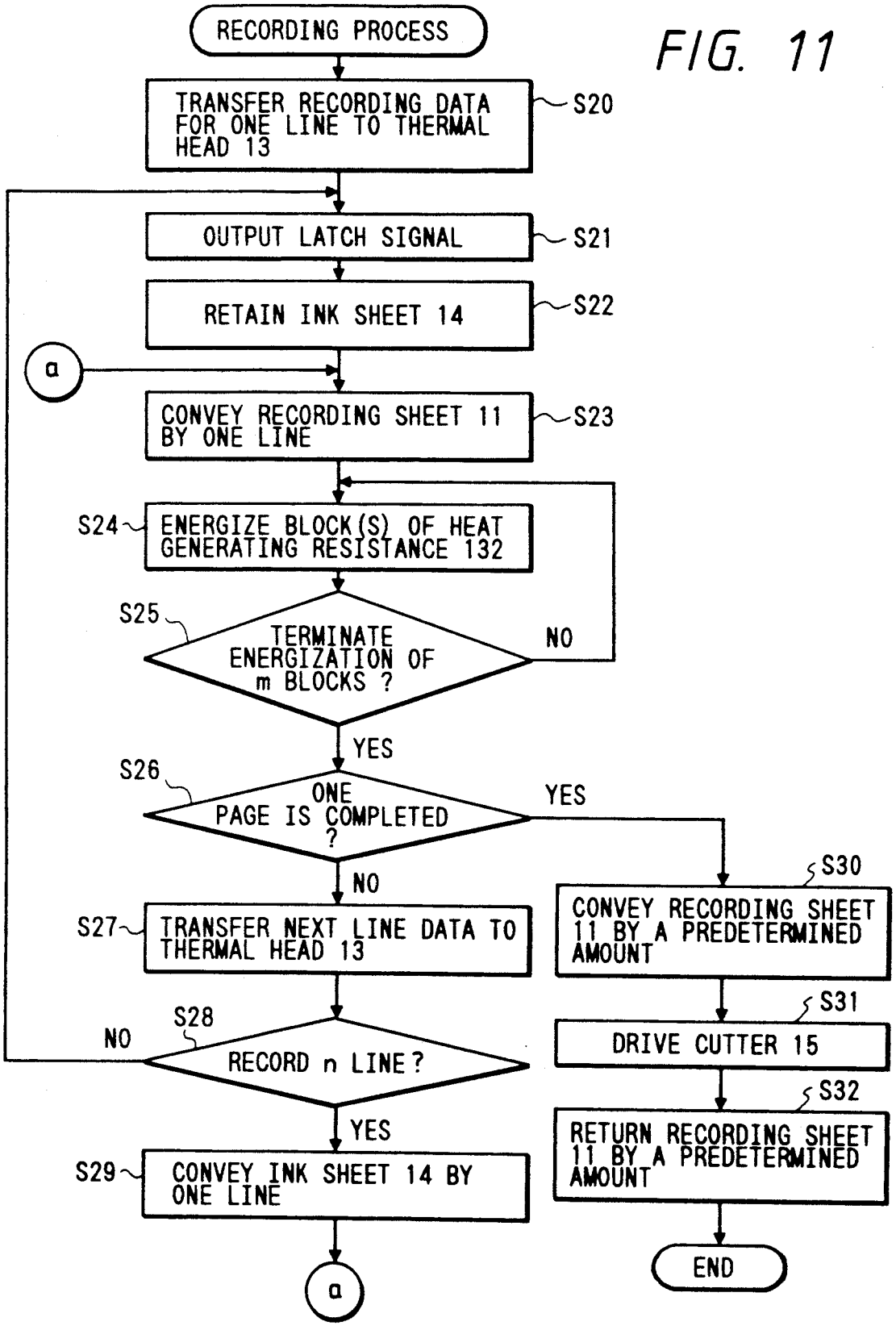
FIG. 11 is a flow chart of the recording sequence in a fourth embodiment.

4th EMBODIMENT (FIG. 11)

FIG. 11 is a flow chart of the thermal transfer recording method of a 4th embodiment. In this embodiment, the recording of n lines is conducted while the ink sheet 14 is stopped, and thereafter the ink sheet 11 is transported for a length of a line in a direction opposite to the transporting direction of the recording sheet 11. The structure of the facsimile apparatus executing the flow chart is similar to that shown in the block diagram in FIG. 2, and a corresponding control program is stored in the ROM 114 of the control unit 101.

Steps S20 and S21, like the steps S1 and S2 in FIG. 7, transfer the recording image data of a line to the thermal head 13. Then a step S22 holds an energizing signal for the ink sheet motor 25, thereby retaining the ink sheet 14 under a tension by the retained torque of said motor. A step S23 activates the recording sheet motor 24, thereby starting the transportation of the recording sheet 11 for a line. Succeeding steps S24, S25, like steps S5 and S6 in FIG. 7, energize the thermal head 13 by means of the power source 105.

Then step S26 discriminates whether the image recording of a page has been completed, and, if not, the sequence proceeds to step S27 for transferring the recording data of a next line to the thermal head 13. The next step S28 discriminates whether the recorded line is an n-th line, and, if not, the sequence returns to step S21 for recording the next line. If the n-th line has been recorded, the sequence proceeds to step S29 for activating the ink sheet motor 25, thereby transporting the ink sheet 14 by a line in the direction a. Then the sequence returns to step S23 for advancing the recording sheet 11 by a line in the direction b, and proceeds to the image recording of the next line. When step S26 identifies completion of the image recording of a page, the sequence proceeds to step S30 Steps S30 to S32 are similar to steps S9 to S11 shown in FIG. 7 and will not therefore be explained further.

Consequently in the recording operation from the 1st to (n−1)-th lines, the relative speed $V_{PI}$ between the recording sheet 11 and the ink sheet 14 is equal to the transporting speed $V_P$ of the recording sheet 11, but said relative speed becomes $2V_P$ at the n-th line.

In the flow chart shown in FIG. 11, the ink sheet 14 is moved by an amount corresponding to a line at the recording of n-th line, but it is also possible to transport the ink sheet 14 s times (s≠n) in the course of recording of n lines, thereby transporting the ink sheet 14 by an amount corresponding to a line in said recording of n lines.

Also in the image recording mentioned above, there is anticipated forced interruption of the image recording by the operator or eventual breakdown of the power source 105 in the course of above-mentioned recording of (n − 1) lines. For this reason it is necessary to transport the ink sheet by an amount corresponding to (l/p) lines (p > 1) prior to the start of image recording. Such ink sheet transportation prevents the use of a same position of the ink sheet 14 in excess of n times in succession.

5th EMBODIMENT (FIGS. 12–15)

Figure 12:
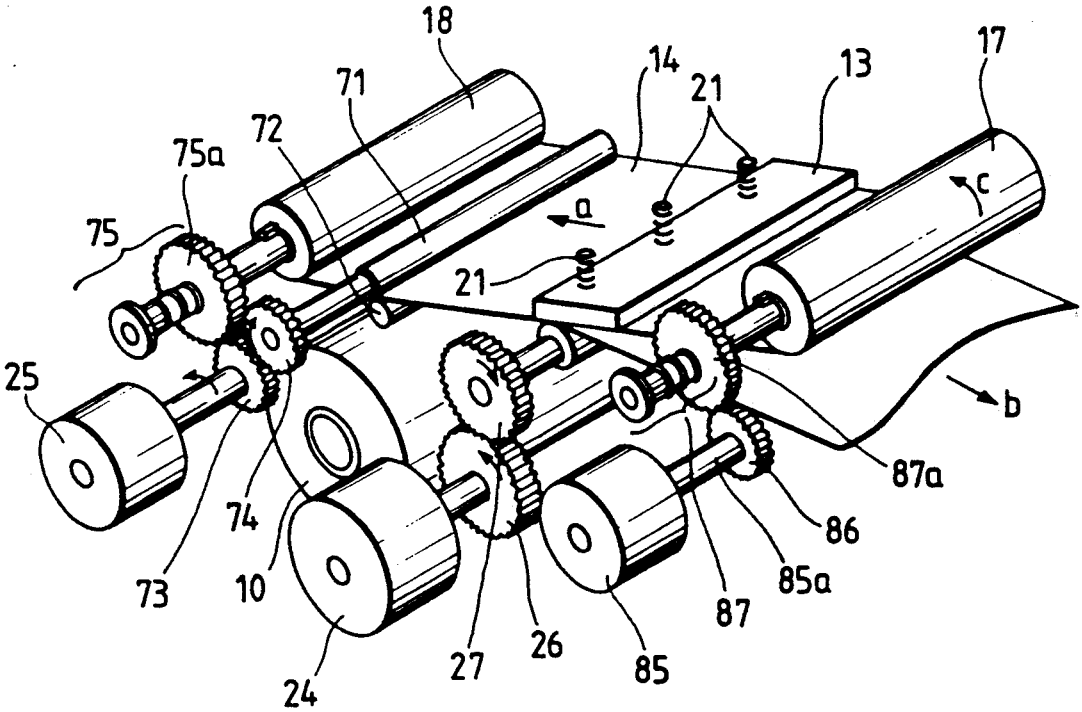
FIG. 12 is a perspective view of a transport system for the ink sheet and the recording sheet in a fifth embodiment.
Figure 13:
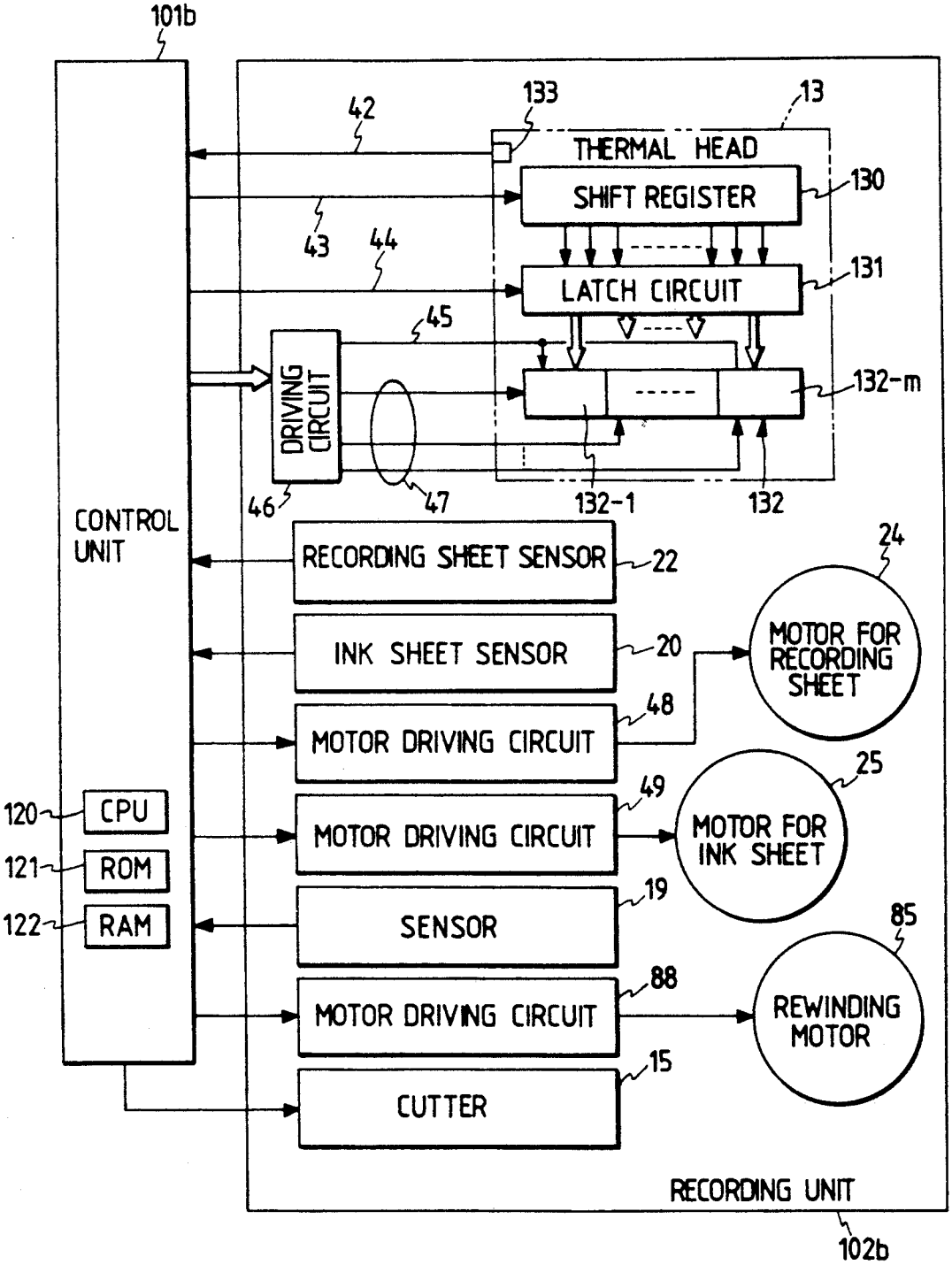
FIG. 13 is a block diagram showing electrical connection between a control unit and a recording unit in the fifth embodiment.

FIG. 12 is a perspective view of the transport system for the ink sheet 14 and the recording sheet 11 in the 5th embodiment, and FIG. 13 is a block diagram of the electrical connections between a control unit 101*b* and a recording unit 102*b* in the 5th embodiment.

The transport system shown in FIG. 12 is provided, in addition to that shown in FIG. 10, with a rewinding motor 85 for rotating the feed roller 17 of the ink sheet 14 in a direction c thereby rewinding the ink sheet 14, and a transmission gear 86 and a slip clutch 87 for transmitting the rotation of the motor to the feed roller 17.

On the shaft 85*a* of the rewinding motor 85 there is mounted a gear 86, which meshes with a gear 87*a* of the slip clutch 87. Thus, clockwise rotation of the gear 86 causes anticlockwise rotation of the gear 87*a*, taking up the ink sheet 14 on the feed roller 17. On the other hand, in the transportation of the ink sheet 14 in the direction a, the feed roller 17 can freely rotate..in a direction opposite to c, by virtue of the slip clutch 87.

Figure 14:
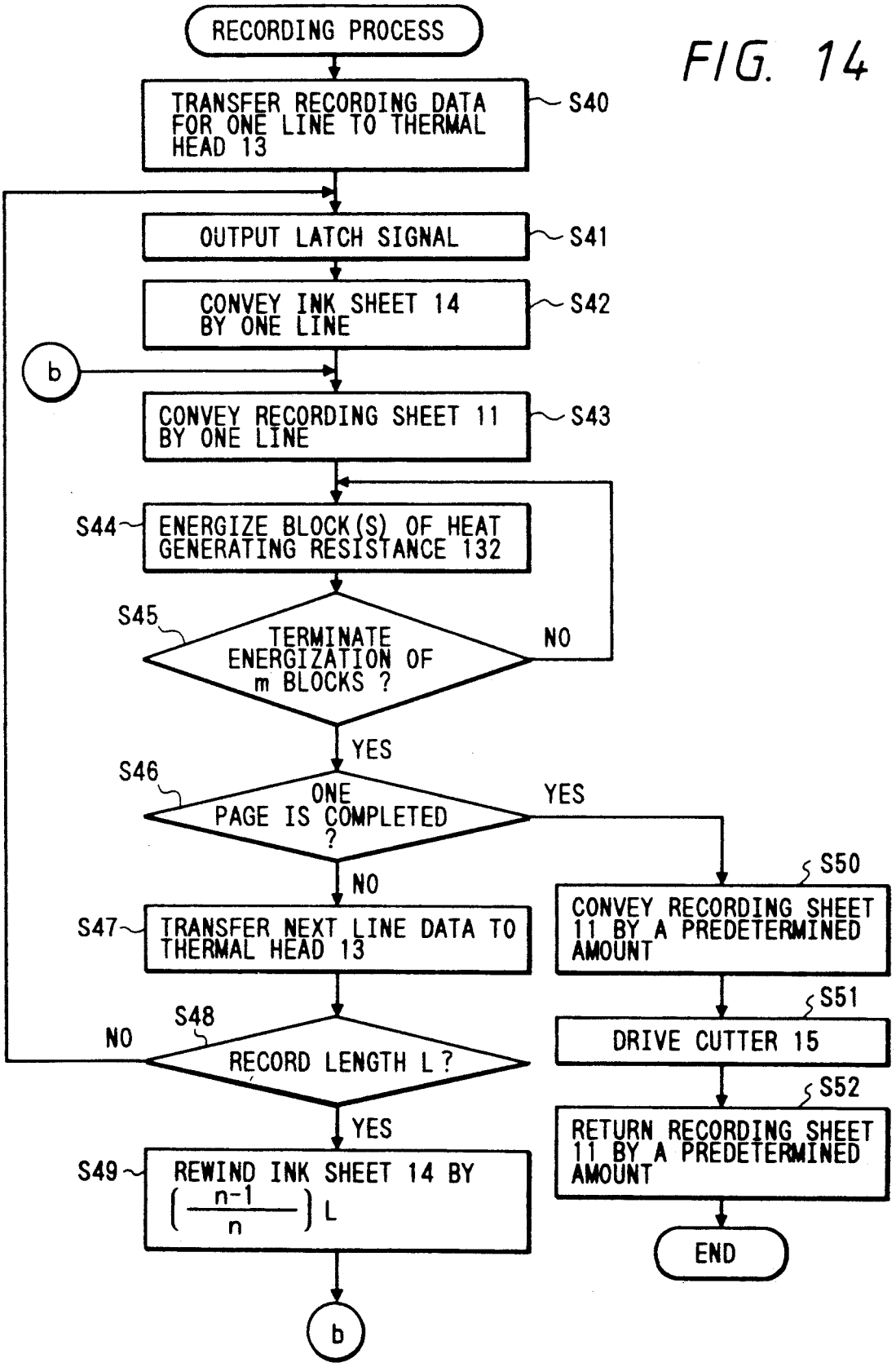
FIG. 14 is a flow chart of the recording sequence in said fifth embodiment.

FIG. 14 is a flow chart of the image recording sequence of the 5th embodiment, and a corresponding program is stored in the ROM 114 of the control unit 101*b*.

The first steps S40 and S41, like steps S1 and S2 in FIG. 7, latch the recording data of a line in the thermal head 13. Then step S42 activates the ink sheet motor 25 thereby transporting the ink sheet by an amount corresponding to a line in a direction a. The next step S43 transports the recording sheet 11 by a line in a direction b. Then steps S44 and S45 record the image of a line in the same manner as steps S5, S6 in FIG. 7.

Step S46 discriminates whether the image recording of a page has been completed, and, if not, the sequence proceeds to step S47 for transferring the image data of a next line to the thermal head 13. The step S48 discriminates whether the image data corresponding to the length "L" of the recording sheet 11 have been recorded, and, if not, the sequence returns to step S41 for recording the image of a next line. On the other hand, if step S48 identifies the recording of the length L, the sequence proceeds to step S49 for reversing the ink sheet motor 25 by the motor driving circuit 49 and returning the ink sheet 14 by (n − 1)L/n in the direction b opposite to the direction a. Also the motor drive circuit 88 drives the rewinding motor 85 by a predetermined amount to take up the ink sheet 14 of a length (n − 1)L/n on the feed roll 17. When the ink sheet 14 is sufficiently rewound, it is protected from unnecessary tension by the function of the slip clutch 87. After rewinding the ink sheet 14, the sequence returns to step S43. On the other hand, if step S46 identifies the completion of image recording of a page, the sequence proceeds to steps S50–S52 for effecting a process similar to that in steps S9 –S11 in FIG. 7.

Thus the ink sheet 14 is used for printing n times at maximum, and this method is effective particularly for cut sheets for which the distance of transportation is firmly defined.

In this embodiment, even if the recording operation is forcedly interrupted the recording operation can be re-started from the current position of the ink sheet. However, the position of the ink sheet 14 at the initial recording position may not be used n times. This is same for the initial part of the ink sheet 14.

Figure 15:
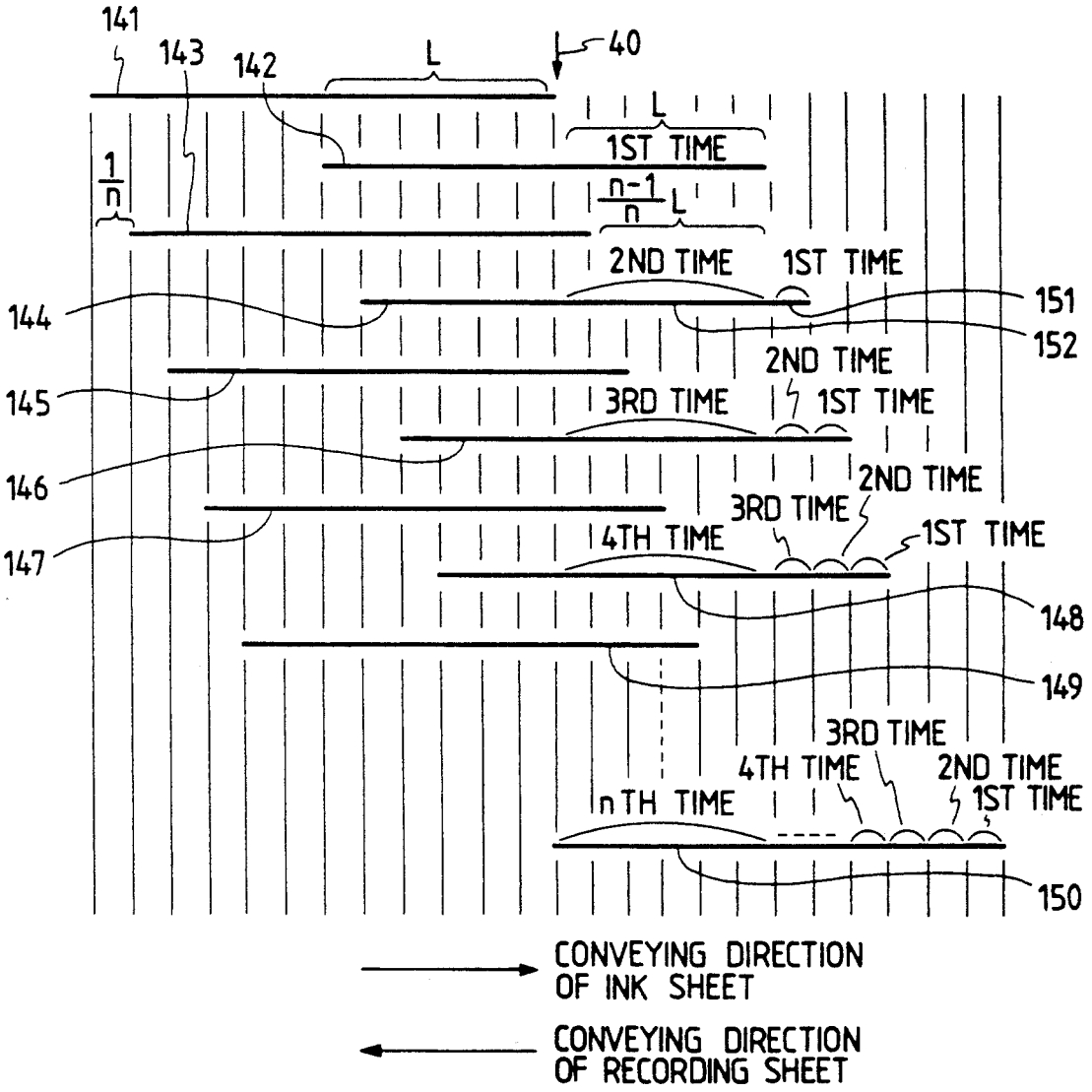
FIG. 15 is a chart showing the mode of use of the ink sheet in the fifth embodiment.

FIG. 15 is a chart showing the transport distance of the sheet 14 and the number of use thereof in the recording operation of the 5th embodiment.

140 indicates the position of the thermal head 13, and 141 indicates a length corresponding to a page prior to the start of image recording. 142 indicates a state after the recording of a length L, and 143 indicates a state after the rewinding of the ink sheet 14 by (n − 1)L/n following the recording of a length L, wherein n is selected as "6". 144 indicates a state after the next recording of the length L, whereby a portion 151 of the ink sheet 14 is used once while a portion 152 is used twice.

Similarly 145 indicates a state after rewinding by L ×5/6 following two recordings, and 146 indicates a state after a recording L only for the 3rd time. Also 147 indicates a state after rewinding by 5L/6 following the third recording. Similarly 148 indicates a state after the 4th recording, and 149 indicates a state after rewinding of 5L/6 thereafter. Therefore, after recordings of n times, as indicated by 150, a length of the used ink sheet 14 corresponding to 1/n is printed once, twice, three times, . . . from the right-hand end.

INK SHEET (FIG. 16)

Figure 16:
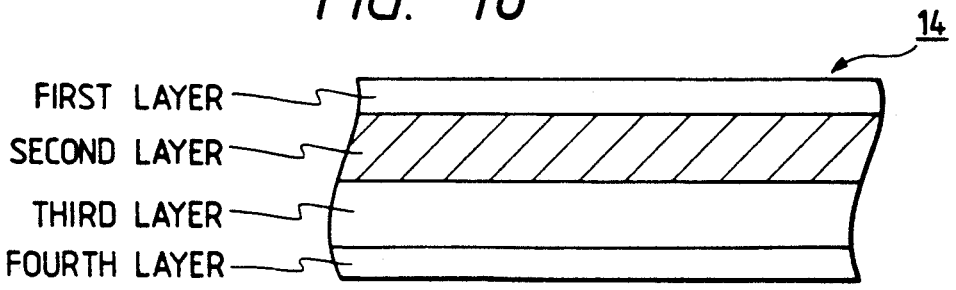
FIG. 16 is a cross-sectional view of the ink sheet employed in the embodiment.

FIG. 16 is a cross-sectional view of the multi-print ink sheet employed in the present embodiment and composed in this case of four layers.

A second layer is composed of a substrate film for the ink sheet 14. In case of multi-printing, as a same position is subjected to thermal energy plural times, there is advantageously employed aromatic polyamide film or condenser paper which has a high thermal resistance, but conventional polyester film may also be employed for this purpose. The thickness of said substrate film is preferably as small as possible for improving the print quality, but is desirably in a range of 3 to 8 μm in consideration of the mechanical strength.

A third layer is an ink layer containing an amount of ink allowing transfers of n times onto the recording sheet. The ink layer is principally composed of an adhesive such as EVA resin, a coloring material such as carbon black or nigrosin a dye, and a binding material such as carnauba wax or paraffin wax, so as to enable uses of n, times in a same place. The coating amount of the ink is preferably in a range of 4 -8 g/m$^2$, but can be arbitrarily selected as the sensitivity or density can be regulated by the coating amount.

A 4th layer is a top coating layer composed for example of transparent wax, for preventing the transfer of the ink of the 3rd layer by pressure to the recording sheet in non-printing portions. The transfer by pressure takes place only in the transparent 4th layer, and so background smudge can be prevented. A 1st layer is a thermally resistant coating, for protecting the substrate film of the 2nd layer from the heat of the thermal head 13. Presence of such coating is preferable for multi-printing in which thermal printing of n lines may be applied to a same position (when black information continues), but the use of such coating may be arbitrarily selected. Also such coating is effective for a substrate film of relatively low heat resistance, such as a polyester film.

The structure of the ink sheet 14 is not limited to this embodiment, but may be composed for example of a substrate layer and a porous, ink containing layer provided on a side of the substrate layer, or of a heat resistant ink layer of a fine porous network structure formed on a substrate film and impregnated with ink. Multiple ink layers can be used. The substrate film can be composed of a film for example of polyamide, polyethylene, polyester, polyvinyl chloride, triacetyl cellulose or nylon, or paper. The heat resistant coating, which is not indispensable, may be composed of silicone resin, epoxy resin, fluorinated resin or nitrocellulose.

As an example, the ink sheet having thermosublimable ink can be composed of a substrate material composed of polyethylene terephthalate, polyethylene naphthalate or aromatic polyamide, and a coloring material layer formed thereon and containing a dye and spacer particles formed from guanamine resin and fluorinated resin.

Also the heating method is not limited to the aforementioned method utilizing a thermal head, but may also be a method of supplying an electric current into the ink layer or a method of ink transfer with a laser beam.

As explained in the foregoing, the present invention enables multi-printing of satisfactory recording quality, by maintaining the wrapping angle of the recording sheet 11 on the platen roller 12 at least at a predetermined value at the upstream side of the recording position in the sheet feeding direction, thereby increasing the frictional force between the recording sheet 11 and the platen roller 12 and securing a relative speed between the recording sheet 11 and the ink sheet 14. Also the present invention widens the range of selection of the value n and the speed $V_P$ of the recording sheet 11, and is effective in case the speed $V_P$ of the recording sheet 11 cannot be increased beyond a certain value (for example 25 mm/s), because of the energy supplied to the thermal head 13, as in a line printer in a facsimile apparatus.

In case the image recording width increases in line printing, the number of heat-generating elements simultaneously energized in the thermal head increases, thereby elevating the shearing force required to separate an ink layer from the ink sheet. This difficulty can be overcome by increasing the relative speed between the recording sheet and the ink sheet beyond a certain value, and the mutually opposite transporting directions of the ink sheet and the recording sheet in the present invention is effective for such case.

The recording medium is not limited to recording paper but can also be composed of cloth or plastic sheet, for example, as long as ink transfer is possible. Also the ink sheet is not limited to the rolled structure shown in the foregoing embodiments but can also be of so-called ink sheet cassette structure in which a casing, housing ink sheets therein, is detachably loaded in the recording apparatus.

Although the foregoing embodiments have been limited to the thermal transfer printer applied to a facsimile apparatus, the recording apparatus of the present invention is applicable also to a word processor, a typewriter, a copying apparatus or the like.

As explained in the foregoing, the present invention enables secure transportation of the recording medium and improves the quality of the recorded image, by increasing the frictional force between the recording medium and transporting means for the recording medium.

What is claimed is:

1. A thermal transfer recording apparatus for image recording on a recording medium by transferring an ink of a member containing the ink therein onto said recording medium by a thermal head, comprising:

a recording medium loading part for loading said recording medium;

a member loading part for loading said member;

a thermal head for acting on aid member loaded in said member loading part thereby recording an image on said recording medium;

a platen roller maintained in contact with said thermal head across said member and said recording medium and serving to transport said recording medium;

a transport path for conveying said recording medium at a recording position by said thermal head, said path being provided with a first friction force applying member and a second friction force applying member both upstream of said recording medium to said thermal head, said first friction force applying member enlarging a contact area between said recording medium and said platen roller and said second friction force applying member enlarging a winding amount of said recording medium which is wound on said first friction force applying member as said recording medium mounted on said recording medium loading part is used; and transport means adapted, at the image recording with said thermal head, for rotating said platen roller and transporting said member so as to have a relative speed between said member and said recording medium.

2. A thermal transfer recording apparatus according to claim 1, wherein a contact angle between said platen roller and said recording medium is between about 60° and about 90°.

3. A thermal transfer recording apparatus according to claim 1, wherein a contact angle between said platen roller and said recording medium is between about 70° and about 85°.

4. A thermal transfer recording apparatus according to claim 1, wherein said apparatus is a facsimile apparatus further comprising a receiving mechanism for receiving an image information through an external communication line.

5. A thermal transfer recording apparatus according to claim 1 wherein said second friction force applying member is provided at a top of an arm member swingable around a rotational axis and said first friction force applying member is located between said second friction force applying member and said rotational axis when said arm member swings.

6. A thermal transfer recording apparatus according to claim 1, wherein said first and said second friction force applying members function to correct a curl of said recording medium.

7. A thermal transfer recording apparatus for image recording on a recording medium by transferring an ink of a member containing the ink therein onto said recording medium by a recording head, comprising:

a recording medium loading part for loading said recording medium;

a member loading part for loading said member;

a platen roller for transporting said recording medium;

frictional force providing means for increasing a frictional force between said recording medium and said platen roller over a shearing force of said member containing ink, said frictional force providing means having a first friction force applying member for enlarging a contact area between said recording medium and said platen roller and a second friction force applying member for enlarging a winding amount of said recording medium which is wound on said first friction force applying member as said recording medium mounted on said recording medium loading part is used;

recording means for effecting said member loaded in said member loading part, thereby recording an image on said recording medium; and transport means adapted, at the image recording with said recording means, for rotating said platen roller and transporting said member in such a manner that said recording medium and said member have a relative speed.

8. A thermal transfer recording apparatus according to claim 1 or 7, wherein said transport means is adapted to transport said recording medium and said member in mutually opposite directions.

9. A thermal transfer recording apparatus according to claims 1 or 7, wherein said transport means transports said member and said recording medium in such a manner that a length of transportation of said member is less than a length of transportation of said recording medium.

10. A thermal transfer recording apparatus according to claim 9, wherein the length of transportation of said ink containing member is 1n of said length of transportation of said recording medium.

11. A thermal transfer recording apparatus according to claim 7 wherein a length of transportation of said ink containing member is 1n of a length of transportation of said recording medium.

12. A thermal transfer recording apparatus according to claim 7, wherein a contact angle between said platen roller and said recording medium is between about 60° and about 90°.

13. A thermal transfer recording apparatus according to claim 7, wherein a contact angle between said platen roller and said recording medium is between about 70° and about 85°.

14. A thermal transfer recording apparatus according to claim 7, wherein said apparatus is a facsimile apparatus further comprising a receiving mechanism for receiving an image information through an external communication line.

15. A thermal transfer recording apparatus according to claim 7, wherein said second friction force applying member is provided at a top of an arm member swingable around a rotational axis and said first friction force applying member is located between said second friction force applying member and said rotational axis when said arm member swings.

16. A thermal transfer recording apparatus according to claim 7, wherein said first and said second friction force applying members function to correct a curl of said recording medium.

* * * * *

UNITED STATES PATENT AND TRADEMARK OFFICE

CERTIFICATE OF CORRECTION

PATENT NO. : 5,179,390

DATED : January 12, 1993

INVENTOR(S) : MINORU YOKOYAMA, ET AL.

It is certified that error appears in the above-identified patent and that said Letters Patent is hereby corrected as shown below:

IN [57] ABSTRACT

Line 11, "in the ink" (second occurrence) should be deleted.

COLUMN 1

Line 45, "ink" should read --an ink-- and
"allows," should read --allows--.

COLUMN 3

Line 21, "nection" should read --nections--.

COLUMN 4

Line 61, "page" should read --page length--.

COLUMN 5

Line 17, "original," should read --original--.

COLUMN 6

Line 35, "increases In" should read --increases. In--.
Line 57, "transporting" should read --the transporting--.

COLUMN 7

Line 16, "201-at" should read --201 at--.
Line 32, "has" should be deleted.

--

UNITED STATES PATENT AND TRADEMARK OFFICE

CERTIFICATE OF CORRECTION

PATENT NO. : 5,179,390

DATED : January 12, 1993

INVENTOR(S) : MINORU YOKOYAMA, ET AL.

It is certified that error appears in the above-identified patent and that said Letters Patent is hereby corrected as shown below:

COLUMN 8

Line 21, "divided" should read --a divided-- and "a" should be deleted.
Line 47, "The" should read --These--.
Line 49, "of" should be deleted.
Line 59, "first" should read --first,--.

COLUMN 9

Line 9, "a step" should read --step S8--.
Line 11, "turns," should read --turns--.
Line 21, "the" (first occurrence) should be deleted.
Line 41, "(1+2/n)Vp." should read --(1+1/n)Vp.--.
Line 47, "said" should read --the--.

COLUMN 11

Line 13, "step S30 Steps S30" should read --step S30. Steps S30--.
Line 57, "rotate..in" should read --rotate in--.

COLUMN 12

Line 31, "interrupted" should read --interrupted,--.

COLUMN 13

Line 10, "nigrosin a" should read --nigrosine--.
Line 12, "n, times" should read --n times--.

--

UNITED STATES PATENT AND TRADEMARK OFFICE

CERTIFICATE OF CORRECTION

PATENT NO. : 5,179,390

DATED : January 12, 1993

INVENTOR(S) : MINORU YOKOYAMA, ET AL.

It is certified that error appears in the above-identified patent and that said Letters Patent is hereby corrected as shown below:

COLUMN 14

Line 40, "aid" should read --said--.

COLUMN 15

Line 13, "claim 1" should read --claim 1,--.

COLUMN 16

Line 18, "1n" should read --1/n--.
Line 21, "claim 7" should read --claim 7,--.
Line 22, "1n" should read --1/n--.

Signed and Sealed this

Seventh Day of December, 1993

Bruce Lehman

*Attest:*

BRUCE LEHMAN

*Attesting Officer*

*Commissioner of Patents and Trademarks*

--